US005850072A

United States Patent [19]

Eckert

[11] Patent Number: 5,850,072

[45] Date of Patent: Dec. 15, 1998

[54] ELECTRIC HEATER ASSEMBLY

[76] Inventor: C. Edward Eckert, 260 Lynn Ann Dr., New Kensington, Pa. 15068

[21] Appl. No.: 882,922

[22] Filed: Jun. 26, 1997

Related U.S. Application Data

[63] Continuation-in-part of Ser. No. 801,769, Feb. 18, 1997.

[51] Int. Cl.[6] ..... H05B 3/06

[52] U.S. Cl. ..... 219/523; 219/535; 219/543; 219/544; 219/553; 428/615; 264/635

[58] Field of Search ..... 219/523, 535, 219/543, 544, 553, 552

[56] References Cited

U.S. PATENT DOCUMENTS

| | | | |
|---|---|---|---|
| 3,774,670 | 11/1973 | Gyöngyös | 164/279 |
| 3,799,410 | 3/1974 | Blossey et al. | 222/566 |
| 3,925,575 | 12/1975 | Church et al. | 427/243 |
| 4,057,433 | 11/1977 | Brown | 106/38.3 |
| 4,153,101 | 5/1979 | Chateau et al. | 164/428 |
| 4,303,181 | 12/1981 | Lewis et al. | 222/591 |
| 4,485,835 | 12/1984 | Huber et al. | 164/430 |
| 4,526,223 | 7/1985 | Ai et al. | 164/428 |
| 4,527,612 | 7/1985 | Yu et al. | 164/428 |
| 4,550,766 | 11/1985 | Ai et al. | 164/428 |
| 4,550,767 | 11/1985 | Yu et al. | 164/428 |
| 4,668,262 | 5/1987 | Kithany | 428/632 |
| 4,798,315 | 1/1989 | Lauener | 222/591 |
| 5,164,097 | 11/1992 | Wang et al. | 222/590 |
| 5,296,288 | 3/1994 | Kourtides | 428/262 |
| 5,310,993 | 5/1994 | McWilliam | 219/449 |
| 5,452,827 | 9/1995 | Eckert | 222/594 |
| 5,474,282 | 12/1995 | Eckert | 428/632 |
| 5,571,440 | 11/1996 | Eckert | 222/594 |
| 5,665,262 | 9/1997 | Hajaligol | 219/553 |
| 5,738,819 | 4/1998 | Feagin | 264/635 |

FOREIGN PATENT DOCUMENTS

| | | | |
|---|---|---|---|
| 1233546 | 2/1967 | Germany | 222/591 |

*Primary Examiner*—Teresa J. Walberg
*Assistant Examiner*—Quan Nguyen
*Attorney, Agent, or Firm*—Andrew Alexander

[57] ABSTRACT

An improved electric heater assembly suitable for heating molten metal, the electric heater assembly having a tube comprised of a closed end suitable for immersing in the molten metal. The tube is fabricated from a composite material comprised of a metal having a coefficient of thermal expansion of less than $10\times10^{-6}$ in/in/° F. and having an outside surface to be exposed to the molten metal coated with a refractory resistant to attack by the molten metal; and an electric heater located in the tube in heat transfer relationship therewith.

27 Claims, 1 Drawing Sheet

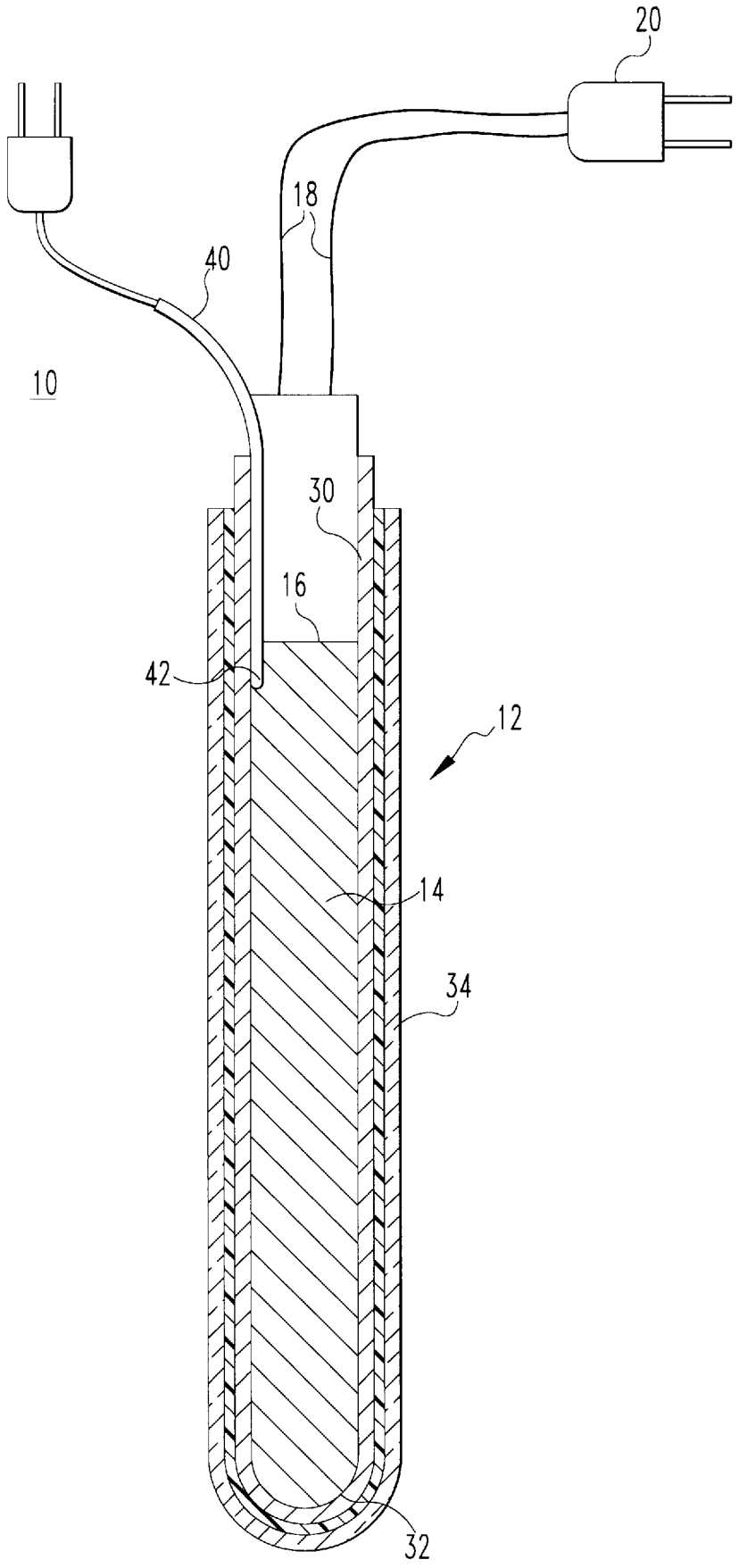
20
18
40
10
30
16
42
12
14
34
32

ELECTRIC HEATER ASSEMBLY

CROSS REFERENCE TO RELATED APPLICATIONS

This application is a continuation-in-part of U.S. Ser. No. 08/801,769, filed Feb. 18, 1997.

BACKGROUND OF THE INVENTION

This invention relates to electric heaters, and more particularly, it relates to electric heaters suitable for use in molten metals such as molten aluminum.

In the prior art electric heaters used for molten aluminum are usually enclosed in ceramic tubes. Such electric heaters are very expensive and are very inefficient in transferring heat to the melt because of the air gap between the heater and the tube. Also, such electric heaters have very low thermal conductivity values that are characteristic of ceramic materials. In addition, the ceramic tubes are fragile and subject to cracking. Thus, there is a great need for an improved electric heater suitable for use with molten metal, e.g., molten aluminum, which is efficient in transferring heat to the melt. The present invention provides such an electric heater.

SUMMARY OF THE INVENTION

It is an object of the invention to provide an improved electric heater assembly.

It is another object of the invention to provide an improved electric heater assembly for use in molten metal such as molten aluminum.

Yet, another object of this invention is to provide an improved electric heater assembly for use in molten metal, the electric heater assembly having a protective sleeve or tube that has intimate physical contact with the heating element, thereby substantially eliminating the air gap between the heater and sleeve.

And yet, another object of the invention is to provide an improved electric heater assembly for use in molten metal, the electric heater assembly having a protective sleeve or tube having a thermal expansion coefficient of less than $15\times10^{-6}$ in/in/° F.

And yet, it is a further object of the invention to provide an improved electric heater assembly for use in molten metal, the electric heater assembly having a protective covering comprised of a material resistant to erosion or dissolution by molten metal such as molten aluminum.

These and other objects will become apparent from the specification, drawings and claims appended hereto.

In accordance with these objects, there is disclosed an improved electric heater assembly suitable for heating molten metal. The electric heater assembly is comprised of a sleeve or container having a closed end suitable for heating molten metal, the sleeve or container fabricated from a composite material comprised of a metal or nonmetal having an outside surface to be exposed to the molten metal coated with a refractory resistant to attack by the molten metal. An electric heating element is located in the sleeve or container in heat transfer relationship therewith for adding heat to the molten metal.

BRIEF DESCRIPTION OF THE FIGURE

The sole FIGURE is a cross-sectional view of an electric heater assembly in accordance with the invention.

DETAILED DESCRIPTION OF THE PREFERRED EMBODIMENTS

Referring to the FIGURE, there is shown a schematic of an electric heater assembly 10 in accordance with the invention. The electric heater assembly is comprised of a protective sleeve or tube 12 and an electric heating element 14. A lead 18 extends from electric heating element 14 and terminates in a plug 20 suitable for plugging into a power source. A suitable element 14 is available from International Heat Exchanger, Inc., Yorba Linda, Calif. 92687 under the designation P/N HTR2252. Also, heating elements are available from Watlow AOU, Anaheim, Calif.

Preferably, protective sleeve or tube 12 is comprised of metal tube 30 having a closed end 32. While the protective sleeve is illustrated as a tube, it will be appreciated that any configuration or container that protects or envelops electric heating element 14 from the molten metal may be employed. By the use of sleeve or tube as used herein is meant to include any kind of means, such as a metal case, container, envelope, casing or covering used to protect the heating element from the molten metal, and the heating element may be inserted into the protective tube and/or the metal case may be formed around the heating element, e.g., by swaging or rolling, and a protective layer applied after forming. Thus, reference to tube herein is meant to include such configurations. A refractory coating 34 is employed which is resistant to attack by the environment in which the electric heater assembly is used. A bond coating may be employed between the refractory coating 34 and metal tube 30. Electric heating element 14 is seated or secured in tube 30 by any convenient means. For example, swaglock nuts and ferrules may be employed or the end of the tube may be crimped or swaged shut to provide a secure fit between the electric heating element and tube 30. In the invention, any of these methods of holding the electric heating element in tube 30 may be employed. It should be understood that tube 30 does not always have to be sealed. In a preferred embodiment, electric heating element 14 is inserted into tube 30 to provide an interference or friction fit. That is, it is preferred that electric heating element 14 has its outside surface in contact with the inside surface of tube 30 to promote heat transfer through tube 30 into the molten metal. That is, often the electric heating element is surrounded or protected with a metal tube such as a steel tube. The electric element is separated from the metal tube with an insulating material such as a metal oxide, e.g., magnesium oxide. It is the outside of the metal tube which is provided with a friction fit with the inside of the tube 30. Thus, air gaps between the surface of the steel tube of electric heating element 14 and inside surface of tube 30 should be minimized.

If electric heating element 14 is inserted in tube 30 with a friction fit, the fit gets tighter with heat because electric heating element 14 expands more than tube 30, particularly when tube 30 is formed from a metal such as titanium having a low coefficient of expansion.

While it is preferred to fabricate tube or metal case 30 out of a titanium based alloy, tube 30 may be fabricated from any metal, or combination of metal and non-metallic or metalloid material with suitable surface protection suitable for contacting molten metal and which material is resistant to dissolution or erosion by the molten metal. Other base materials that may be used to fabricate tube 30 include silicon, niobium, chromium, molybdenum, cobalt, iron, nickel based alloys including combinations of NiFe (364 NiFe) and NiTiC (40 Ni 60TiC), IN783®, INCONEL®, LAPALLOY®, INVAR® or KOVAR®, particularly when such materials have low thermal expansion, e.g., less than $10\times10^{-6}$ in/in/° F., all referred to herein as metals. For protection purposes, it is preferred that the metal or metalloid be coated with a material such as a refractory resistant to attack by molten metal and suitable for use as a protective sleeve.

One of the important features of a desirable material for tube 30 is thermal expansion. Thus, a suitable material should have a thermal expansion coefficient of less than $15\times10^{-6}$ in/in/° F., with a preferred thermal expansion coefficient being less than $10\times10^{-6}$ in/in/° F., and the most preferred being less than $8\times10^{-6}$ in/in/° F. and typically less than $5\times10^{-6}$ in/in/° F. All ranges herein include all the numbers within the range as if specifically set forth.

As noted, the preferred material for fabricating into tubes 30 is a titanium base material or alloy having a thermal expansion coefficient less than $15\times10^{-6}$ in/in/° F., preferably less than $10\times10^{-6}$ in/in/° F., and typically less than $5\times10^{-6}$ in/in/° F.

The material or metal out of which tube 30 is fabricated preferably has an interfacial shear stress with refractory coating 34 of 2 to 175 KSI and preferably 15 to 45 KSI and typically less than 35 KSI at a surface temperature of 1080° F. of the tube and a surface temperature of 1300° F. refractory surface.

When the electric heater assembly is being used in molten metal such as lead, for example, the titanium based alloy need not be coated to protect it from dissolution. For other metals, such as aluminum, copper, steel, zinc and magnesium, refractory-type coatings should be provided to protect against dissolution of the metal or metalloid tube by the molten metal.

For most molten metals, the titanium alloy that should be used is one that preferably meets the thermal conductivity requirements and the thermal expansion coefficient noted herein. Further, typically, the titanium alloy should have a yield strength of 30 ksi or greater at room temperature, preferably 70 ksi, and typical 100 ksi. The titanium alloys included herein and useful in the present invention include CP (commercial purity) grade titanium, or alpha and beta titanium alloys or near alpha titanium alloys, or alpha-beta titanium alloys. The alpha or near-alpha alloys can comprise, by wt. %, 2 to 9 Al, 0 to 12 Sn, 0 to 4 Mo, 0 to 6 Zr, 0 to 2 V and 0 to 2 Ta, and 2.5 max. each of Ni, Nb and Si, the remainder titanium and incidental elements and impurities.

Specific alpha and near-alpha titanium alloys contain, by wt. %, about:

(a) 5 Al, 2.5 Sn, the remainder Ti and impurities.

(b) 8 Al, 1 Mo, 1 V the remainder Ti and impurities.

(c) 6 Al, 2 Sn, 4 Zr, 2 Mo, the remainder Ti and impurities.

(d) 6 Al, 2 Nb, 1 Ta, 0.8 Mo, the remainder Ti and impurities.

(e) 2.25 Al, 11 Sn, 5 Zr, 1 Mo, the remainder Ti and impurities.

(f) 5 Al, 5 Sn, 2 Zr, 2 Mo, the remainder Ti and impurities.

The alpha-beta titanium alloys comprise, by wt. %, 2 to 10 Al, 0 to 5 Mo, 0 to 5 Sn, 0 to 5 Zr, 0 to 1 IV, 0 to 5 Cr, 0 to 3 Fe, with 1 Cu max., 9 Mn max., 1 Si max., the remainder titanium, incidental elements and impurities.

Specific alpha-beta alloys contain, by wt. %, about:

(a) 6 A, 4 V, the remainder Ti and impurities.

(b) 6 Al, 6 V, 2 Sn, the remainder Ti and impurities.

(c) 8 Mn, the remainder Ti and impurities.

(d) 7 Al, 4 Mo, the remainder Ti and impurities.

(e) 6 Al, 2 Sn, 4 Zr, 6 Mo, the remainder Ti and impurities.

(f) 5 Al, 2 Sn, 2 Zr, 4 Mo, 4 Cr, the remainder Ti and impurities.

(g) 6 Al, 2 Sn, 2 Zn, 2 Mo, 2 Cr, the remainder Ti and impurities.

(h) 10 V, 2 Fe, 3 Al, the remainder Ti and impurities.

(i) 3 Al, 2.5 V, the remainder Ti and impurities.

The beta titanium alloys comprise, by wt. %, 0 to 14 V, 0 to 12 Cr, 0 to 4 Al, 0 to 12 Mo, 0 to 6 Zr and 0 to 3 Fe, the remainder titanium and impurities.

Specific beta titanium alloys contain, by wt. %, about:

(a) 13 V, 11 Cr, 3 Al, the remainder Ti and impurities.

(b) 8 Mo, 8 V, 2 Fe, 3 Al, the remainder Ti and impurities.

(c) 3 Al, 8 V, 6 Cr, 4 Mo, 4 Zr, the remainder Ti and impurities.

(d) 11.5 Mo, 6 Zr, 4.5 Sn, the remainder Ti and impurities.

When it is necessary to provide a coating to protect tube 30 of metal or metalloid from dissolution or attack by molten metal, a refractory coating 34 is applied to the outside surface of tube 30. The coating should be applied above the level to which the electric heater assembly is immersed in the molten metal. The refractory coating can be any refractory material which provides the tube with a molten metal resistant coating. The refractory coating can vary, depending on the molten metal. Thus, a novel composite material is provided permitting use of metals or metalloids having the required thermal conductivity and thermal expansion for use with molten metal which heretofore was not deemed possible.

When the electric heater assembly is to be used for heating molten metal such as aluminum, magnesium, zinc, or copper, etc., a refractory coating may comprise at least one of alumina, zirconia, yittria stabilized zirconia, magnesia, magnesium titanite, mullite, a combination of alumina and titania or a material such as SiAlON (silicon aluminum oxynitride). While the refractory coating can be used on the metal or metalloid comprising the tube, a bond coating can be applied between the base metal and the refractory coating. The bond coating can provide for adjustments between the thermal expansion coefficient of the base metal alloy, e.g., titanium, and the refractory coating when necessary. The bond coating thus aids in minimizing cracking or spalling of the refractory coat when the tube is immersed in the molten metal or brought to operating temperature. When the electric heater assembly is cycled between molten metal temperature and room temperature, for example, the bond coat can be advantageous in preventing cracking, particularly if there is a considerable difference between the thermal expansion of the metal or metalloid and the refractory if the interfacial shear stress is too high. Preferably, the refractory coating has a porosity of about 3 to 22% and median pore diameter of 0.01 to 0.15 mm. The refractory coating may be fully dense but it is more subject to thermal shock.

Typical bond coatings comprise Cr—Ni—Al alloys and Cr—Ni alloys, with or without precious metals. Bond coatings suitable in the present invention are available from Metco Inc., Cleveland, Ohio, under the designation 460 and 1465. In the present invention, the refractory coating should have a thermal expansion that is plus or minus five times that of the base material. Thus, the ratio of the coefficient of expansion of the base material to the refractory coating can range from 5:1 to 1:5, preferably 1:3 to 1:1.5. The bond coating aids in compensating for differences between the base material and the refractory coating.

The bond coating has a thickness of 0.1 to 8 mils with a typical thickness being about 0.5 mil. The bond coating can be applied by sputtering, plasma or flame spraying, chemical vapor deposition, spraying, dipping or mechanical bonding by rolling, for example.

After the bond coating has been applied, the refractory coating is applied. The refractory coating may be applied by any technique that provides a uniform coating over the bond coating. The refractory coating can be applied by aerosol, sputtering, plasma or flame spraying, for example. Preferably, the refractory coating has a thickness in the range of 0.3 to 42 mils, preferably 5 to 15 mils, with a suitable thickness being about 10 mils. The refractory coating may be used without a bond coating.

In another aspect of the invention, silicon carbide, boron nitride, silicon nitride, and other metal oxides, and combinations of carbides, nitrides and oxides, may be applied as a thin coating on top of the refractory coating. The thin coating should be non-wetting or metallaphobic, that is, have a contact angle of greater than 90° with liquid or molten material in which the heater is immersed. Thus, any non-wetting coating which has these characteristics may be used. The preferred material is boron nitride. The non-wetting coating may be applied mechanically, vacuum impregnated, sprayed, or co-plasma sprayed with the refractory coating. The boron nitride may be applied as a dry coating, or a dispersion of boron nitride and water may be formed and the dispersion applied as a spray. The non-wetting coating is not normally more than about 2 or 3 mils in thickness, and typically it is less than 2 mils.

When boron nitride or other non-wetting refractory material is applied dry or in a water dispersion, the particle size should be sufficiently small, e.g., less than 75 $\mu$m and typically less than 30 $\mu$m, to permit intrusion of the boron nitride particles into the pores of the refractory coating.

The heater assembly of the invention can operate at watt densities of 15 and preferably 40 to 375 watts/in$^2$.

The heater assembly in accordance with the invention has the advantage of a metallic-composite sheath for strength and improved thermal conductivity. The strength is important because it provides resistance to mechanical abuse and permits an intimate contact with the internal element. Intimate contact between heating element and sheath I.D. provides substantial elimination of an annular air gap between heating element and sheath. In prior heaters, the annular air gap resulted in radiation heat transfer and also back radiation to the element from inside the sheath wall which limits maximum heat flux. By contrast, the heater of the invention employs an interference fit that results in essentially only conduction.

In another aspect of the invention, it has been found that intimate contact or fit can be obtained by swaging metal tube 30 about or onto heating element 14. It will be appreciated that element 14 is circular in cross section and, therefore, tube 30 can be swaged tightly onto element 14, thereby substantially eliminating air gaps. Swaging includes the operation of working and partially reshaping metal tube 30, particularly the inside diameter, placing in compression, the tube contents, and more exactly fitting the outside diameter of element 14 to eliminate air gaps between element 14 and tube 30. It will be appreciated that intermediate tubes may be placed between the heating element of the heater assembly and tube 30. Further, the invention contemplates a heating element wire or rod surrounded by an electrical insulating material such as a powder which has good heat conduction, e.g., magnesium oxide, contained by tube 30 without any intermediate tubes such as steel tubes.

When tube 30 is swaged on heater element 14, the refractory coating is applied after swaging. Whether the heater assembly is made by inserting heating element 14 into tube 30 or by swaging, as noted, it can be beneficial to use a contact medium for better heat conduction between heating element 14 and tube 30. The contact medium can be a powdered material located between the heating element and the tube. The powdered material can be selected from silicon carbide, magnesium oxide and carbon or graphite if the heating element is contained in an intermediate tube. If no intermediate tube is used, the contact medium must provide electrical insulation as well as good heat conduction. The powdered material should have a median particle size ranging from about 0.03 to 0.3 mm. The powdered material has the effect of filling any voids between the heating element and the tube. The range of size for the powdered material improves heat conduction by minimizing void fraction. Swaging is very beneficial with the powdered material because the swaging effectively packs the powder tighter for improved heat conduction.

The inside of tube 30 may be treated to provide a roughening effect or controlled RMS for improved packing of powder against the inside wall of tube 30. That is, having a range of particle size and a roughened inside wall provides a higher level of contact by said powdered contact medium and therefore a greater level of heat conduction to the wall. In addition, providing the element with a roughened surface improves heat conduction to the powdered contact medium. If an intermediate metal tube, e.g., a steel tube, is used, then it is also important to provide it with a roughened surface for heat transfer.

Another contact medium that may be used includes high temperature pastes such as anti-seize compounds having a nickel or copper base.

In conventional heaters, the heating element is not in intimate contact with the protection tube resulting in an annular air gas or space therebetween. Thus, the element is operated at a temperature independent of the tube. Heat from the element is not efficiently removed or extracted by the tube, greatly limiting the efficiency of the heaters. Thus, in conventional heaters, the element has to be operated below a certain fixed temperature to avoid overheating the element, greatly limiting the heat flux.

The heater assembly of the invention very efficiently extracts heat from the heating element and is capable of operating close to molten metal, e.g., aluminum temperature. The low coefficient of expansion of the composite sheath, which is lower than the heating element, maintains intimate contact of the heating element with the composite sheath.

In another feature of the invention, a thermocouple 40 may be inserted between sleeve 12 and heating element 14. The thermocouple may be used for purposes of control of the heating element to ensure against overheating of the element in the event that heat is not transferred away sufficiently fast from the heating assembly. Further, the thermocouple can be used for sensing the temperature of the molten metal by an analog method. That is, sleeve 12 may extend below or beyond the end of the heating element to provide a space and the sensing tip of the thermocouple can be located in the space.

In a preferred embodiment, thermocouple 40 is positioned such that tip 42 of thermocouple 40 is located adjacent end 16 of the heating element. Having tip 42 positioned adjacent or near end 16 ensures that the heater assembly is immersed in the liquid metal. That is, because of the high level of heat generated by the heater assembly, it is important that the heating element be submerged in order to remove heat efficiently. If part of the heating element extends above the metal line, the element can overheat causing damage to the assembly.

In the present invention, it is important to use a heater control. That is, for efficiency purposes, it is important to operate heaters at the highest watt density while not exceeding the maximum allowable element temperature. The thermocouple placed or positioned in the heater assembly senses the temperature of the heater element. The thermocouple can be connected to a controller such as a cascade logic controller to integrate the heater element temperature into the control loop. Such cascade logic controllers are available from Watlow Controls, Winona, Minn., designated Series 988.

While the invention has been described in terms of preferred embodiments, the claims appended hereto are intended to encompass other embodiments which fall within the spirit of the invention.

What is claimed is:

1. An electric heater assembly suitable for heating molten metal, the electric heater assembly comprised of:

(a) a tube having a closed end suitable for immersing in said molten metal, the tube fabricated from a composite material comprised of a metal case having a thermal coefficient of expansion of less than $10\times10^{-6}$ in/in/° F., (i) the metal case fabricated from a metal selected from the group consisting of titanium or titanium alloy stainless steel nickel based alloys and iron based alloys; and (ii) the tube having an outside surface to be exposed to said molten metal coated with a refractory coating having a coefficient of expansion less than $10\times10^{-6}$ in/in/° F. and being resistant to attack by said molten metal;

(b) an electric heating element located in said tube in heat transfer relationship therewith for adding heat to said molten metal; and (c) a powdered contact medium provided in said tube between said heating element and said tube, the contact medium having the ability to conduct heat from said heating element to said tube to improve heat transfer.

2. The electric heater assembly in accordance with claim 1 wherein the metal case has a thermal expansion coefficient of less than $5\times10^{-6}$ in/in/° F.

3. The electric heater assembly in accordance with claim 1 wherein the metal case is comprised of a titanium alloy selected from the group consisting of alpha, beta, near alpha, and alpha-beta titanium alloys having a thermal coefficient of expansion of $5\times10^{-6}$ in/in/° F.

4. The electric heater assembly in accordance with claim 1 wherein the metal case is formed from a titanium based alloy selected from the group consisting of 6242, 1100 and CP grade.

5. The electric heater assembly in accordance with claim 1 wherein a bond coating is provided between the outside surface of the metal case and the refractory.

6. The electric heater assembly in accordance with claim 1 wherein the refractory coating is selected from the group consisting of one of $Al_2O_3$, $ZrO_2$, $Y_2O_3$ stabilized $ZrO_2$, SiAlON and $Al_2O_3$—$TiO_2$.

7. The electric heater assembly in accordance with claim 1 wherein a bond coating having a thickness in the range of 0.1 to 8 mils is provided on said outside surface between said metal case and said refractory.

8. The electric heater assembly in accordance with claim 1 wherein said refractory has a thickness in the range of 0.3 to 42 mils.

9. The electric heater assembly in accordance with claim 1 wherein a bond coating is provided between said outside surface and said refractory coating and said bond coating comprises an alloy selected from the group consisting of a Cr—Ni—Al alloy and a Cr—Ni alloy.

10. The electric heater assembly in accordance with claim 1 wherein the refractory comprises alumina.

11. The electric heater assembly in accordance with claim 1 wherein the refractory coating comprises zirconia.

12. The electric heater assembly in accordance with claim 1 wherein the refractory coating comprises yittria stabilized zirconia.

13. The electric heater assembly in accordance with claim 1 wherein the refractory coating comprises 5 to 20 wt. % titania and the balance alumina.

14. The electric heater assembly in accordance with claim 1 wherein the electric heating element is provided in said metal case which is deformed by one of rolling and swaging, said rolling and swaging performed prior to applying said refractory coating.

15. An electric heater assembly suitable for heating molten metal, the electric heater assembly comprised of a tube having a closed end suitable for immersing in said molten metal, the tube fabricated from a composite material comprised of:

(a) a base metal layer of a titanium alloy having a coefficient of expansion less than $10\times10^{-6}$ in/in/° F.;

(b) a bond coat bonded to an outside surface of said base layer to coat said surface to be exposed to said molten metal;

(c) a refractory layer bonded to said bond coat, the refractory layer resistant to attack by said molten metal, the refractory layer having a coefficient of expansion less than $10\times10^{-6}$ in/in/° F.;

(d) an electric heating element positioned in said tube in heat transfer relationship; and (e) a contact medium provided in said tube between said heating element and said tube to fill air gaps between said element and said tube, the contact medium having the ability to conduct heat from said element to said tube and improve heat transfer.

16. The heater assembly in accordance with claim 15 wherein said contact medium is one of a powdered material.

17. The heater assembly in accordance with claim 15 wherein the powdered material has a median particle size in the range of 0.03 to 0.3 mm.

18. A method of forming an electric heater assembly for heating molten metal, the electric heater assembly comprised of a tube having a closed end suitable for immersing in said molten metal, the tube fabricated from a composite material comprising the steps of:

(a) providing a tube of metal selected from the group consisting of a titanium based alloy, nickel based alloy, iron based alloy and stainless steels, said metal having a coefficient of thermal expansion of less than $8\times10^{-6}$ in/in/° F.;

(b) providing a contact medium in said tube;

(c) locating an electric heater in said tube;

(d) forming said tube about said heating element thereby compressing said contact medium;

(e) applying a bond coat bonded to an outside surface of said metal to coat said surface to be exposed to said molten metal; and (f) applying a refractory layer to said bond coat, the refractory layer resistant to attack by said molten metal, the refractory layer having a coefficient of expansion less than $10\times10^{-6}$ in/in/° F.

19. The method in accordance with claim 18 wherein said forming includes rolling or swaging.

20. An electric heater assembly suitable for heating molten metal, the electric heater assembly comprised of:

(a) a tube having a closed end suitable for immersing in said molten metal, the tube fabricated from a composite material comprised of metal case having a thermal coefficient of expansion of $10\times10^{-6}$ in/in/° F. and having an outside surface to be exposed to said molten metal coated with a refractory resistant to attack by said molten metal;

(b) an electric heating element located in said tube in heat transfer relationship therewith for adding heat to said molten metal; and (c) a thermocouple positioned in said tube for purposes of monitoring the heat output of said heating element and preventing said heating element from overheating.

21. A composite material for use with molten metal, the composite material having a tensile strength of greater than 30 ksi and being resistant to attack by the molten metal, the composite material comprising:

(a) a base layer of metal having an expansion coefficient of less than $10\times10^{-6}$ in/in/° F.;

(b) a bond coating applied to a surface of said base layer, the bond coating having a thickness in the range of 0.1 to 8 mils and a thermal coefficient of expansion of less than $10\times10^{-6}$ in/in/° F.;

(c) a protective refractory coating applied to said bond coating, the refractory coating having a coefficient of expansion of less than $10\times10^{-6}$ in/in/° F., said refractory coating bonded to said bond coating; and (d) a molten metal substantially non-wetting coating applied to said refractory coating, said non-wetting coating selected from one of the group consisting of silicon carbide, boron nitride, silicon aluminum oxynitride and silicon nitride.

22. The composite material in accordance with claim 21 wherein said base layer of metal is selected from one of the group consisting of a titanium based alloy, a nickel based alloy and stainless steel, said base layer of metal having a coefficient of thermal expansion less than $8\times10^{-6}$ in/in/° F.

23. The composite material in accordance with claim 21 wherein said nonwetting coating is boron nitride.

24. The composite material in accordance with claim 21 wherein said refractory coating has a porosity of 3 to 22%.

25. The composite material in accordance with claim 21 wherein said refractory coating is selected from a material consisting of $Al_2O_3$, $ZnO_2$, $Y_2O_3$ stabilized $ZnO_2$, $Al_2O_3$, SiAlON and $TiO_2$.

26. A composite material for use with molten aluminum, the composite material having a tensile strength of greater than 30 ksi and being resistant to attack by said molten aluminum, the composite material comprising:

(a) a base layer of titanium base alloy having an expansion coefficient of less than $5\times10^{-6}$ in/in/° F.;

(b) a bond coating applied to a surface of said base layer, the bond coating having a thickness in the range of 0.1 to 5 mils and a thermal coefficient of expansion of less than $10\times10^{-6}$ in/in/° F.;

(c) a protective refractory coating having a coefficient of expansion of less than $10\times10^{-6}$ in/in/° F. and resistant to attack by said molten aluminum, said refractory coating bonded to said bond coating and having a thickness in the range of 4 to 22 mils, the refractory coating having a porosity of 3 to 22%; and (d) a boron nitride coating applied to said refractory coating, the boron nitride being substantially non-wettable by said molten aluminum.

27. The composite material in accordance with claim 26 wherein said refractory coating is selected from a material consisting of $Al_2O_3$, $ZnO_2$, $Y_2O_3$ stabilized $ZnO_2$, $Al_2O_3$, SiAlON and $TiO_2$.

* * * * *